US010344406B2

(12) United States Patent
Wirth et al.

(10) Patent No.: US 10,344,406 B2
(45) Date of Patent: Jul. 9, 2019

(54) CORE-SPUN YARN FEATURING A BLENDED CORE FOR USE IN THE CONSTRUCTION OF FLAME BARRIER FABRICS AND FINISHED ARTICLES MADE THEREFROM

(71) Applicant: Springs Creative Products Group, LLC, Rock Hill, SC (US)

(72) Inventors: John V Wirth, Rock Hill, SC (US); George E Booth, Rock Hill, SC (US)

(73) Assignee: Springs Creative Products Group, LLC, Rock Hill, SC (US)

( * ) Notice: Subject to any disclaimer, the term of this patent is extended or adjusted under 35 U.S.C. 154(b) by 43 days.

(21) Appl. No.: 15/405,127

(22) Filed: Jan. 12, 2017

(65) Prior Publication Data

US 2018/0195214 A1 Jul. 12, 2018

(51) Int. Cl.

| | |
|---|---|
| ***D03D 15/12*** | (2006.01) |
| ***D02G 3/44*** | (2006.01) |
| ***D02G 3/36*** | (2006.01) |

(52) U.S. Cl.

CPC ..... *D03D 15/12* (2013.01); *D02G 3/367* (2013.01); *D02G 3/44* (2013.01); *D02G 3/443* (2013.01); *D10B 2331/021* (2013.01)

(58) Field of Classification Search

CPC ..... D03D 15/00; D03D 15/12; D02G 3/367; D02G 3/443; D02G 3/44; D10B 2331/02; D10B 2331/021; D10B 2331/04; D10B 2331/06–30

See application file for complete search history.

(56) References Cited

U.S. PATENT DOCUMENTS

| | | | | |
|---|---|---|---|---|
| 4,327,779 | A * | 5/1982 | Westhead | D02G 3/36 139/383 A |
| 4,921,756 | A * | 5/1990 | Tolbert | D02G 3/185 428/373 |
| 4,994,317 | A * | 2/1991 | Dugan | A41D 31/0027 428/402 |
| 5,534,336 | A * | 7/1996 | Nomura | D02G 3/042 428/397 |
| 5,568,719 | A * | 10/1996 | Proctor | D02G 3/367 57/12 |
| 2006/0185343 | A1* | 8/2006 | Coombs | D02G 3/36 57/210 |
| 2012/0142241 | A1* | 6/2012 | Booth | D02G 3/185 442/190 |
| 2015/0267323 | A1* | 9/2015 | Frisch | D02G 3/36 428/221 |

* cited by examiner

*Primary Examiner* — Ismael Izaguirre
(74) *Attorney, Agent, or Firm* — Leason Ellis LLP

(57) ABSTRACT

A fire resistant core-spun yarn that comprises a unitary core having a blend of a filament fiber and non-filament fibers, and a sheath containing one or more staple fibers that substantially encapsulates the unitary core; and flame barrier substrates and articles made therefrom.

20 Claims, 5 Drawing Sheets

CORE-SPUN YARN FEATURING A BLENDED CORE FOR USE IN THE CONSTRUCTION OF FLAME BARRIER FABRICS AND FINISHED ARTICLES MADE THEREFROM

FIELD OF THE DISCLOSURE

The present disclosure relates to a method for manufacturing a core-spun yarn comprising a blended core yarn encased in a sheath of staple fibers and a fire resistant core-spun yarn that may include a combination of filament and non-filament blended as a single core.

BACKGROUND OF THE DISCLOSURE

Springs Creative's Firegard® line of core-spun flame barrier fabrics pioneered the market with a novel technique for encasing a heat-stable core within a sheath of staple fibers. The novel technique used air jet spinning technology to manufacture a single-core yarn that commonly included silica fibers as the core.

Apparently inspired by the Firegard® line of core-spun flame barrier fabrics, a dual-core, dual-sheath yarn was manufactured using air jet spinning. In these yarns, a fiberglass core was accompanied by a second nylon core yarn. The two individual yarns were fed into a front roll nip on an air jet spinning machine to be encased in a sheath of melamine fiber, forming the core of the resultant yarn. These yarns were subsequently reprocessed to apply a more aesthetically pleasing sheath around the yarn composite.

Also apparently inspired by the Firegard® line of core-spun flame barrier fabrics, plaiting of yarns has been used to manufacture a fire resistant substrate. In this process, a heat stable yarn is used in parallel with a second, fire-resistant yarn. The heat stable yarn is most often fiberglass. The two individual yarns are dispensed from their respective packages and are introduced into a feeder on a knit machine as if they were one yarn.

Currently available yarns have sought to influence fire retardant performance through manipulation of the composition of the sheaths. An unfulfilled need exists for a fire retardant yarn having superior properties and performance that can be manufactured efficiently, cost-effectively, and consistently.

SUMMARY OF THE DISCLOSURE

According to one non-limiting example of the disclosure, a method is disclosed for manufacturing a core-spun yarn comprising a blended core yarn encased in a sheath of staple fibers that delivers superior fire retardant performance and properties.

According to another non-limiting example of the disclosure, a fire resistant core-spun yarn is disclosed herein. The fire resistant core-spun yarn may include a combination of filament and non-filament yarns combined into a single core.

The fire resistant core-spun yarn may comprise a sheath of staple fibers encasing a unitary core made from a blend of a plurality of distinct fiber types. The plurality of distinct fibers may include two, three, or more distinct fibers. The plurality of distinct fibers may be pre-blended into a bundle core by a pre-blending process prior to being encased by a subsequent spinning process which will apply a sheath to the core. The pre-blending process may comprise providing the plurality of distinct fibers (e.g., substantially parallel to each other) and twisting the fibers in, e.g., a counterclockwise (or clockwise) direction where the sheath fibers may be applied using, e.g., a clockwise (or counterclockwise) twist. The twist direction of the sheath will be in opposition to the twist direction of the core.

The core blending process may include, but is not limited to, for example: intimate blending; drawframe blending; a plying and twisting process; a siro spinning process (e.g., a spaced, double-creeled roving feeding the draft zone of a textile spinning frame); a ring spinning process; an air jet spinning process; and/or a friction spinning process.

The fire resistant core-spun yarn may comprise a sheath of staple fibers encasing a unitary core made from a blend of three or more distinct fibers blended via the blending process.

The fire resistant core-spun yarn may comprise a sheath of staple fibers encasing a unitary core made from a blend of three or more distinct fibers whose core may be twisted in, for example, a counterclockwise direction and whose sheath fibers may be applied using, for example, a clockwise twist to render a non-lively yarn with balanced twist.

The fire resistant core-spun yarn may comprise a sheath of staple fibers encasing a unitary core made from a blend of three or more distinct fibers whose core may combine one or more continuous filament yarns and one or more non-filament yarns.

The fire resistant core-spun yarn may comprise a sheath of staple fibers encasing a unitary core made from a blend of three or more distinct fibers whose core may comprise plied strands made from non-filament fiber.

The fire resistant core-spun yarn may comprise a sheath of staple fibers encasing a unitary core made from a blend of three or more distinct fibers whose blended core creates higher quality core spun yarns due to an increased ability to mechanically attach (or latch) sheath fibers to the core.

The fire resistant core-spun yarn may comprise a sheath of staple fibers encasing a unitary core made from a blend of three or more distinct fibers, and may be suitable for the manufacture of knitted or woven flame barrier substrates for use in, for example, mattress, furniture, transportation applications, and the like.

The fire resistant core-spun yarn may comprise a sheath of staple fibers encasing a unitary core made from a blend of three or more distinct fibers providing increased control over desired physical and performance properties. These properties may include an increase in tensile strength, abrasion resistance, a reduced propensity for shrinkage, machine washability, and/or other desirable attributes. Performance attributes may include fire resistant performance without the use of chemical flame retardants, increased heat resistance, moisture management, temperature regulation (e.g., for comfort), antimicrobial or odor arresting properties, and the like.

The fire resistant core-spun yarn may comprise a sheath of staple fibers encasing a unitary core made from a blend of three or more distinct fibers wherein the fibers comprising the core may exhibit significantly higher heat resistance to enable their use in applications that may be subject to much higher temperature exposure. Such enhanced cores may include blends of aramid, ceramic, basalt, glass fiber, fire retardant rayon, polyacrylonitrile (PAN), Oxidized polyacrylonitrile (OPAN), PBI, polyetherimide, and/or the like.

A core of the core-spun yarn may include one or more metallic strands.

The fire resistant core-spun yarn may comprise a sheath of staple fibers encasing a unitary core made from a blend of three or more distinct fibers whose core may include blended multifilament and monofilament components.

The fire resistant core-spun yarn may comprise a sheath of staple fibers encasing a unitary core made from a blend of three or more distinct fibers whose blended unitary core may enable the creation of a wider range of yarn counts than is possible with an unblended single core.

The fire resistant core-spun yarn may comprise a sheath of staple fibers encasing a unitary core made from a blend of three or more distinct fibers whose fiber composition may enable substrates made from the yarn to be machine laundered. The composition and morphology of the fire resistant core-spun yarn overcomes the disparity in shrinkage between the yarn's core and sheath found in currently available yarns.

According to an aspect of the disclosure, by selecting fibers and imparting opposing twist on the sheath and core, the core-spun yarn may equilibrate shrinkage.

The impartation of opposing twist may enhance the creation of spaces between fibers, thereby promoting better attachment of the sheath fibers to the core. The resultant fire resistant core-spun yarns may be smoother and less prone to strip-backs (e.g., the exposure of the core due to friction from other yarns) than currently available yarns.

The fire resistant core-spun yarn may comprise a sheath of staple fibers encasing a unitary core made from a blend of three or more distinct fibers with improved softness (e.g., textile "hand") resulting from the combination.

According to a further aspect of the disclosure, a flame barrier substrate is disclosed. The flame barrier substrate may comprise one or more fire resistant core-spun yarns described herein. The substrates may be suitable, for example, for the manufacture of mattresses that comply with full-scale flammability tests, such as US 16 CFR 1633, or for the manufacture of upholstered furniture that complies with full-scale burn tests such as California Technical Bulletin 133.

According to a further aspect of the disclosure, a flame barrier substrate is disclosed. The flame barrier substrate may include one or more fire resistant core-spun yarns described herein. For instance, the fire resistant core-spun yarn may comprise a sheath of staple fibers encasing a unitary core made from a blend of three or more distinct fibers of two or more different types. The various yarns in the substrate may be differentiated by, for example, the composition of the fibers, the blending process and/or the spinning method employed to manufacture the yarns and/or flame barrier substrate.

The flame barrier substrate(s) may be constructed using alternating yarns of different types. The alternating yarns may include different yarn compositions and/or structures (e.g., core-spun and non-core-spun yarns in alternation). The flame barrier substrate(s) may include differing yarn types on the technical face and the back of the substrate(s).

According to a still further aspect of the disclosure, a non-limiting example of a fire retardant or flame resistant yarn is disclosed. The fire retardant or flame resistant yarn comprises a pre-blended core, which may be produced using a core processor as described herein. The fire retardant or flame resistant yarn may comprise multiple strands, and is the fire retardant or flame resistant yarn may be suitable in itself for producing a flame barrier substrate.

This pre-blended core may be encased in a sheath of textile fiber to enhance its fire retardant performance, or a non-fire retardant (FR) sheath may be applied to produce other aesthetic or other attributes or benefits.

The pre-blended cores may be included as-is in a knitting or weaving process to form a flame barrier substrate or with the non-FR sheaths applied, or in some combination of the two. These pre-blended cores may be used as substantially 100% of the resultant fabric's mass, or could also be used in conjunction with core-sheath yarns and or with other FR and or inert yarns depending on the desired properties of the flame barrier.

The pre-blended core may include strands made from colored or dyed fibers, or which strands may comprise colored or dyed yarns. The introduction of color may yield a visually pleasing aesthetic and or may be used for more efficient identification of a specific yarn size, fabric construction or fiber blend. These benefits are not construed to be mutually exclusive.

The pre-blended core—with or without added color—may be encased in a sheath of colored fiber to create inherently colored yarns that would not require a subsequent dyeing or printing process. Fabrics made from the yarns described herein may have a color which may facilitate identification of a construction, blend, brand or type of flame barrier, and or which may be made consistent with the branding or trade dress of the end article, such as, e.g., a mattress or other upholstered article, to increase its aesthetic appeal to an end consumer.

According to yet another non-limiting aspect of this disclosure, a fire retardant or flame resistant yarn may be created that comprises a pre-blended core (made by a core processor) enveloped within a sheath. The sheath may comprise fibers with an affinity for sublistatic dyes or digital printing inks. When knitted or woven into flame barrier substrates, the resultant fabrics may be receptive to the impartation of colors, patterns or designs to enhance the visual and aesthetic appeal and or to underscore the brand identity of the end use item into which the flame barrier would be installed.

According to the principles of the disclosure, a pre-blended core is provided whose FR properties can be more precisely calibrated through, for example, the core processor, within a sheath of fibers with an affinity for sublistatic dyes and or digital printing inks.

Additional features, advantages, and embodiments of the disclosure may be set forth or apparent from consideration of the detailed description and drawings. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

Figure 1:
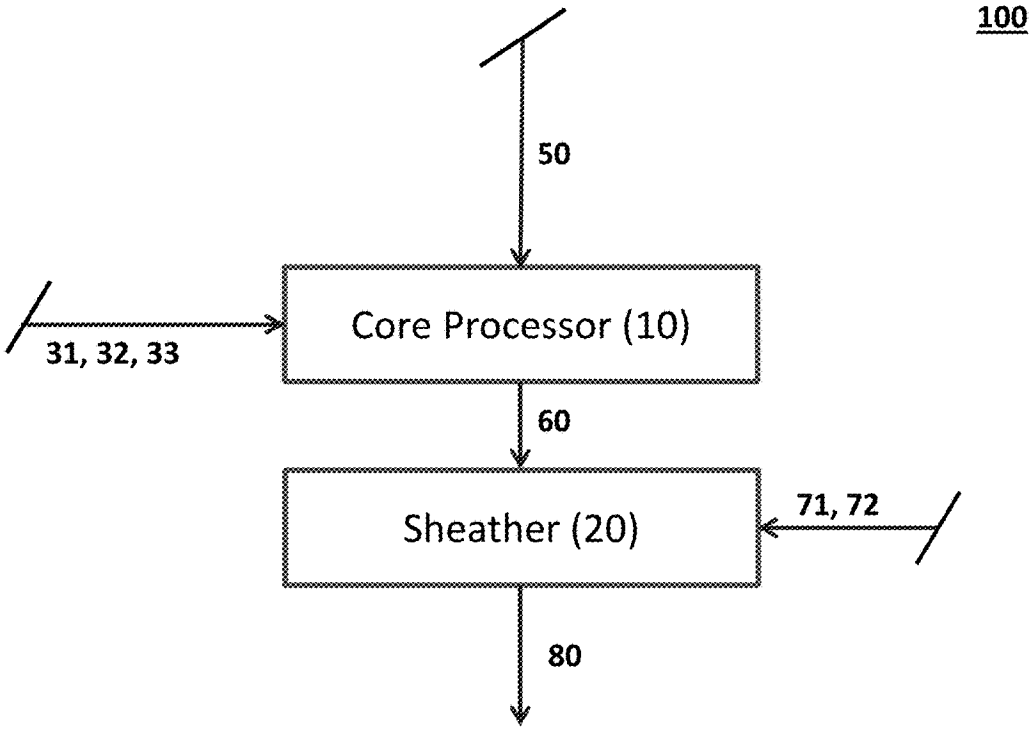
FIG. 1 shows an example of a system for manufacturing a fire resistant core-spun yarn, according to the principles of the disclosure.

The present disclosure is further described in the detailed description that follows.

DETAILED DESCRIPTION OF THE DISCLOSURE

The disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

FIG. 1 shows an example of a system 100 for manufacturing a fire resistant core-spun yarn, according to principles of the disclosure. The system 100 comprises a core processor 10 and a sheather 20. The core processor 10 is configured to receive at least one continuous filament fiber 50 and at least one non-filament fiber type 31, 32, 33. The core processor 10 is further configured to form parallel strands from at least one continuous filament fiber 50 and at least one non-filament fiber type 31, 32, 33 and twist the strands to form a unitary core.

According to one non-limiting embodiment, the core processor 10 may be configured to receive a plurality of non-filament fibers (or yarn) 31, 32, 33 from a respective plurality of sources (not shown) to form one or more strands of non-filament yarn. The filament fiber 50 may be received as a single, continuous fiber (or yarn). The core processor 10 may form and supply a plurality (e.g., two, three, or more) strands of the yarn to a twisting stage.

The plurality of non-filament fibers 31, 32, 33, may include a plurality of fiber types, each of which may be different from the others. The filament fiber 50 is blended with the plurality of fibers 31, 32, 33 in the core processor 10 to form a core bundle 60.

The filament fiber 50 may include any high temperature resistant, continuous filament that exhibits heat-stable properties, including, for example, a fiberglass fiber (e.g., A-fiberglass, C-fiberglass, D-fiberglass, E-fiberglass, E-CR fiberglass, R-fiberglass, S-fiberglass, etc.), a ceramic fiber, a metal fiber (e.g., steel, copper, gold, silver, nickel, aluminum, iron, titanium, platinum, etc.), a fire retardant rayon fiber, an aramid fiber (e.g., poly-m-phenylene isophthalamide, poly-diphenylether para-aramid, etc.), a fluoropolymer (e.g., polytetrafluoroethylene, polyethylene-chrlorotriflouroethylene, polyvinylidene fluoride, polyperflouroalkoxy, etc.), a polysulfonamide fiber, a polybenzimidazole fiber, a polyamideimide fiber, a nylon fiber, an extended-chain polyethylene fiber, a polybenzaimidazole fiber, a melamine fiber, an oxidized (partially or wholly oxidized) polyacrylonitrile fiber, a modacrylic fiber, a polykeytone fiber, a novoloid fiber, and the like.

The plurality of non-filament fibers 31, 32, 33 may include a plurality of fiber types, including, for example, cotton, wool, polyester, nylon, rayon, fiberglass, polyolefin, acrylic, silk, mohair, polyvinyl chloride (PVC), and/or any other naturally occurring or manufactured materials that may be usable as a staple fiber, as understood by one skilled in the art.

The core processor 10 may include any known equipment that may be used to carry out the purposes of the present disclosure, including, e.g., the equipment described in the patent documents discussed below, which are incorporated herein by reference. The core processor 10 may include, for example, a tripling device (not shown) and a twisting device (not shown). The tripling device may draw out and supply parallel strands of yarn to the twisting device, in parallel. For instance, the tripling device may supply a pair of parallel strands comprising staple fibers in parallel with at least one strand of continuous filament fiber. The strands of staple fibers may be made up different types of staple fibers. The twisting device receives the parallel strands of filament(s)/non-filament fibers and twists them to form a unitary core structure. The plurality of strands (including the non-filament fibers 31, 32, 33 and filament fiber(s) 50) may be supplied substantially parallel to each other to the twisting device, where the strands may be twisted in forming a unitary core.

The strand(s) comprising the one or more non-filament fibers 31, 32, 33 and filament fiber(s) 50 may be twisted in, for example, a counterclockwise (or clockwise) direction with respect to, e.g., a longitudinal axis of the resultant bundle core. The sheath fibers may be twisted in the opposite, clockwise (or counterclockwise) direction about the core bundle 60 to render a non-lively yarn with balanced twist. The twisting may be carried with sufficient force to cause additional contraction of the core bundle 60, thereby (possibly) elongating the core-spun yarn 80. By selecting fibers and imparting opposing twisting on the sheathing and core, the core-spun yarn may equilibrate shrinkage.

The twist process may enhance the creation of spaces between fibers, thereby promoting better attachment of the sheath fibers to the core. The resultant fire resistant core-spun yarns is smoother and less prone to strip-backs (e.g., the exposure of the core due to friction from other yarns) than currently available yarns. The twist process may impart an "S" and/or "Z" twist. The core processor 10 may include, for example, an intimate blending device, a drawframe, a plying and twisting device, a siro spinning device (such as, e.g., a spaced, double-creeled roving feeding the draft zone of a textile spinning frame), a ring spinning device, an air jet spinning device, and/or a friction spinning device, as known by those skilled in the art. For instance, the core processor 10 may include a device that carries out blending, carding, and drawing. All of the foregoing devices were readily available at the time of this writing.

The sheather 20 may be integrated with the core processor 10 as a single device, or provided separately. The sheather 20 may be similar to the core processor 10. For instance, the sheather 20 may include, e.g., a spinning frame equipped to produce core-spun yarn, or any other readily available device that may be used to form a single sheath around the unitary core, according to the principles of the present disclosure. The sheather 20 is configured to receive one or more of staple fibers 71, 72 and form a sheath layer (or sheath) 90 (shown in FIG. 2) about the bundle core 60, encasing the core 60 within sheath layer 90 to form the fire resistant core-spun yarn 80. The staple fibers 71, 72 may include different (or the same) types of fibers.

The following U.S. patent documents disclose illustrative examples of devices and/or processes that may be used for, or included in the core processor 10, which are hereby incorporated herein by reference as if fully set forth herein, including: U.S. Pat. No. 6,606,846, titled "a fire resistant core-spun yarn and fabric comprising same"; U.S. Pat. No. 7,469,526, titled "a heat/fire resistant sewing thread and method for producing same"; U.S. Patent Application Publication No. US 2004/0002272, titled "a fire resistant core-spun yarn and fabric comprising same"; U.S. Patent Application Publication No. US 2006/0160451, titled "knit tube flame resistant barriers"; U.S. Patent Application Publication No. US 2011/0274903, titled "weighted fabric articles and related materials and methods"; U.S. Pat. No. 4,936,085, titled "yarn and glove"; U.S. Pat. No. 5,177,948, titled "yarn and glove"; U.S. Pat. No. 5,423,168, titled "surgical glove and yarn"; U.S. Pat. No. 5,506,043, titled "thermal protective fabric and core-spun heat resistant yarn for making the same, said yarns consisting essentially of a fiberglass core and a cover of modacrylic fibers and at least one other flame retardant fiber"; U.S. Pat. No. 5,555,716, titled "yarn having microfiber sheath surrounding non-microfiber core"; U.S. Pat. No. 6,287,690, titled "fire resistant core-spun yarn and fabric comprising same"; and U.S. Pat. No. 6,410,140, titled "fire resistant core-spun yarn and fabric comprising same."

As an alternative to introducing a mechanical twist to the bundle core and/or to a resulting composite core/sheath yarn, the respective core strands may be entangled, interlaced or interleaved through the imposition of, for example, a false twist. This false twist may be imparted through the use of a vortex of air, such as may be found in an air jet spinning machine or in an air texturizing machine.

Figure 2:
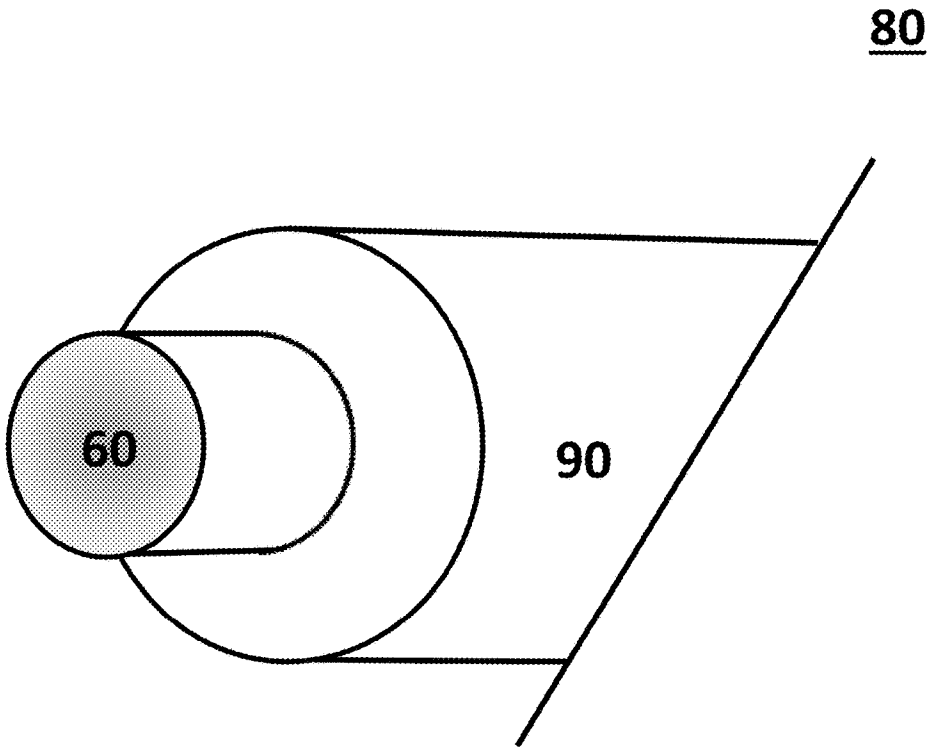
FIG. 2 shows a representation of the core-spun yarn, according to the principles of the disclosure.

FIG. 2 shows a representation of the fire resistant core-spun yarn 80, including the unitary core 60 and the sheath of staple fibers 90. The fire resistant core-spun yarn 80 comprises the single sheath layer 90 of staple fibers encasing the unitary core 60 made from a blend of, e.g., two, three, or more distinct fiber types, wherein the fibers comprising the core may exhibit significantly higher heat resistance to enable their use in applications that may be subject to much higher temperature exposure.

The fire resistant core-spun yarn 80 may comprise a sheath of staple fibers encasing a unitary core made from a blend of three or more distinct fibers whose core may comprise plied strands made from staple fiber.

Referring to FIG. 2, and as discussed above, the unitary core 60 comprises at least one continuous, heat-resistant filament fiber and a plurality of non-filament fiber types, which may (or may not) include fire-resistant non-filament fibers. The sheath 90 comprises staple fibers, which may include one or more staple fiber types.

A substrate made from the core-spun yarn 80 may have properties such as, for example, a tensile strength ranging from about 30 lbs/in to about 50 lbs/in, a burst strength ranging from about 40 lbs/sq. in to about 150 lbs/sq. in, elongation ranging from about 70% to about 200%. The core 60 may constitute from about 40% (weight %) to about 60% (wt %) of the total weight of the core-spun yarn. The sheath 90 may constitute the remainder of the wt % of the core-spun yarn.

Fire resistance may be measured by vertical burn testing according to ASTM D6413, and/or by a bench-scale simulation of the NIST propane burner employed in full-scale mattress burn tests. In addition, 16 CFR 1633 full-scale mattress burn tests or California Technical Bulletin 133 full-scale furniture burn tests may be conducted.

Figure 3:
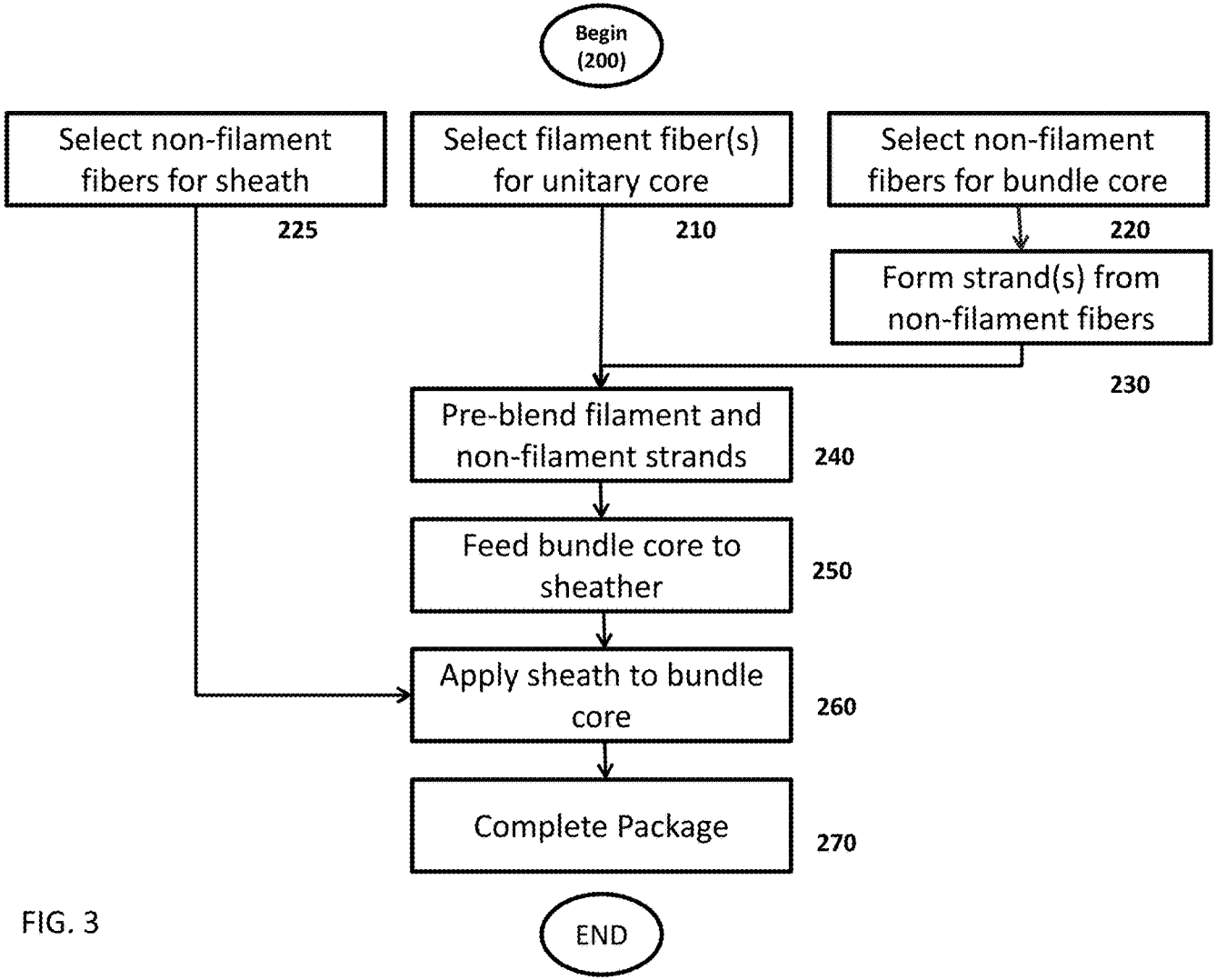
FIG. 3 shows an example of a process for manufacturing the fire resistant core-spun yarn, according to the principles of the disclosure.

FIG. 3 shows an example of a process flow schematic 200 for manufacturing the fire resistant core-spun yarn 80, according to the principles of the disclosure.

Referring to FIG. 3, the process 200 begins with selecting one or more filament fiber(s) for the unitary core (Step 210), selecting companion non-filament fiber types (Step 220) to be blended to form the unitary core 60 of the fire resistant core-spun yarn 80. The process 200 may include selecting one or more non-filament fibers for the sheath (225). One or more staple fibers may be selected for the sheath layer. The filament fiber(s), combination of non-filament fiber types, and staple fibers may be selected depending on the particular application or requirements for the core-spun yarn 80. The selection of filament (Step 210), non-filament fibers (Step 220) and sheath non-filament fibers (Step 225) may be carried out substantially at the same time or at different times.

The combinations of filament fiber and non-filament fiber types may be selected to optimize properties of the core-spun yarn, such as, for example, but not limited to, fire retardance, latchability to sheath fibers, high tensile strength, abrasion resistance, reduced propensity for shrinkage, machine washability, and/or other desirable attributes. The combinations of filament fiber and non-filament fiber types may be also selected to optimize performance attributes such as, for example, but not limited to, fire resistance without the use of chemical flame retardants, increased heat resistance, moisture management, temperature regulation (e.g., for comfort), antimicrobial or odor arresting properties, and/or the like.

Through selection of the filament fiber and non-filament fiber types and wt. % values, it is possible according to the principles of the present disclosure to control and optimize fire resistance properties of the resultant core-spun yarn.

The staple fibers may also be selected to optimize properties of the core-spun yarn, including the above-mentioned properties.

The non-filament fiber(s) may be formed into strands (Step 230) and supplied in parallel to a pre-blending device that blends the filament and non-filament strands to form a bundle core (Step 240). The pre-blending device may include a twisting device that twists the parallel strands to form the bundle core (Step 240). The pre-blending device may be comprised of the core processor 10 (shown in FIG. 1). The process may include, e.g., drawing, tripling (or doubling, quadrupling, etc., depending on the number of strands) and twisting of the fiber strands. The resultant bundle core is fed to a sheather (e.g., sheather 20, shown in FIG. 1) to envelop the bundle core in a sheath of non-filament (e.g., staple) fibers (Step 250). The staple fibers may be twisted in a direction that is opposite to the twisting in the bundle core. The sheather envelops the bundle core in the sheath of staple fibers by, e.g., applying a sheath to the bundle core (Step 260). The resultant core-spun yarn is a balanced, non-lively textile yarn.

The resultant core-spun yarn may be packaged and output (Step 270) in a form that may be used in downstream processes. For instance, the resultant core-spun yarn may be used alone or combined with other yarns to form flame barrier substrates for upholstered furniture, mattresses, clothing, safety apparel, etc. Other substrates may be formed which may be used in, e.g., certain transportation or industrial or safety applications such as, e.g., fire-fighting, emergency response, shipping, trucking, aerospace, maritime, etc.

The flame barrier substrate(s) may include alternating yarns. The alternating yarn types may include different yarn types—e.g., different blends and/or compositions and/or sizes. The substrates could be made alternating the differing yarn types and or could place the yarns, respectively, on the technical face and back of the substrate.

Accordingly, through selection of filament fiber(s) and staple fibers, a fire resistant core-spun yarn may be made that comprises a sheath of staple fibers encasing a unitary core made from a blend of two, three, or more distinct fibers suitable for the manufacture of knitted or woven flame barrier substrates for use in, for example, a mattress, furniture, and/or a transportation application, and the like.

The fire resistant core-spun yarn produced according to the principles of the present disclosure may comprise, for example: a sheath of staple fibers encasing a unitary core made from a blend of three or more distinct fibers whose core may include blended multifilament and monofilament components; a sheath of staple fibers encasing a unitary core made from a blend of three or more distinct fibers whose blended unitary core may enable the creation of a wider range of yarn counts than is possible with an unblended single core; a sheath of staple fibers encasing a unitary core made from a blend of three or more distinct fibers whose fiber composition may enable substrates made from the yarn to be machine laundered; a sheath of staple fibers encasing a unitary core made from a blend of three or more distinct fibers with improved softness (e.g., textile "hand") resulting from the combination; a sheath of staple fibers encasing a unitary core made from a blend of two or more distinct fibers; a sheath of staple fibers encasing a unitary core made from a blend of three or more distinct fibers blended via intimate blending; a sheath of staple fibers encasing a unitary core made from a blend of three or more distinct fibers blended via drawframe blending; a sheath of staple fibers encasing a unitary core made from a blend of three or more distinct fibers blended via a plying and twisting process; a sheath of staple fibers encasing a unitary core made from a blend of three or more distinct fibers blended via a siro spinning process—a/k/a a spaced, double-creeled roving feeding the draft zone of a textile spinning frame; a sheath of staple fibers encasing a unitary core made from a blend of three or more distinct fibers produced using a ring spinning process; a sheath of staple fibers encasing a unitary core made from a blend of three or more distinct fibers made using an air jet or friction spinning process; a sheath of staple fibers encasing a unitary core made from a blend of three or more distinct fibers whose core is twisted in, for example, a counterclockwise direction and whose sheath fibers are applied using clockwise twist to render a non-lively yarn with balanced twist; a sheath of staple fibers encasing a unitary core made from a blend of three or more distinct fibers whose core combines filament and staple fibers; a sheath of staple fibers encasing a unitary core made from a blend of three or more distinct fibers whose core consists of plied strands made from staple fibers; a sheath of staple fibers encasing a unitary core made from a blend of three or more distinct fibers whose blended core creates higher quality core spun yarns due to an increased ability to mechanically attach sheath fibers to the core (a/k/a "latch"); a sheath of staple fibers encasing a unitary core made from a blend of three or more distinct fibers suitable for the manufacture of knitted or woven flame barrier substrates for use in mattress, furniture and transportation applications; a sheath of staple fibers encasing a unitary core made from a blend of three or more distinct fibers providing increased control over desired physical and performance properties; and a sheath of staple fibers encasing a unitary core made from a blend of three or more distinct fibers whose fiber composition enables substrates made from these yarns to be machine laundered.

The impartation of opposing twist between the core and sheath, according to the principles of the present disclosure, facilitates the creation of spaces between fibers which enables the free ends of sheath fibers to become entrapped, resulting in a smoother, more stable sheath. The resultant core-spun yarn provides improved yarn strength and evenness, improved softness and luster, and the opportunity to reduce processing costs and other costs related to off-quality. The opportunity to reduce manufacturing costs may be contingent on the yarn count and the fibers selected, as well as other factors, such as, e.g., the basis weight of the resultant substrate and the fabrication of the end article.

According to the present disclosure, the composition and morphology of the core-spun yarn 80 has little or no disparity in shrinkage between the yarn's core and sheath. The yarn equilibrates shrinkage through the selection of fibers as well as the method of imparting opposing twist in the sheath and core, respectively. The use of opposing twist directions will enhance the creation of spaces between fibers that will promote better attachment of the sheath fibers to the core, making the yarns smoother and less prone to strip-backs—the exposure of the core due to friction from other yarns or guide eyes in processing. Compared to available fire resistant yarns, the core-spun yarn 80 offers an increased range of capabilities along with opportunities to produce lower-cost flame barriers.

Figure 4:
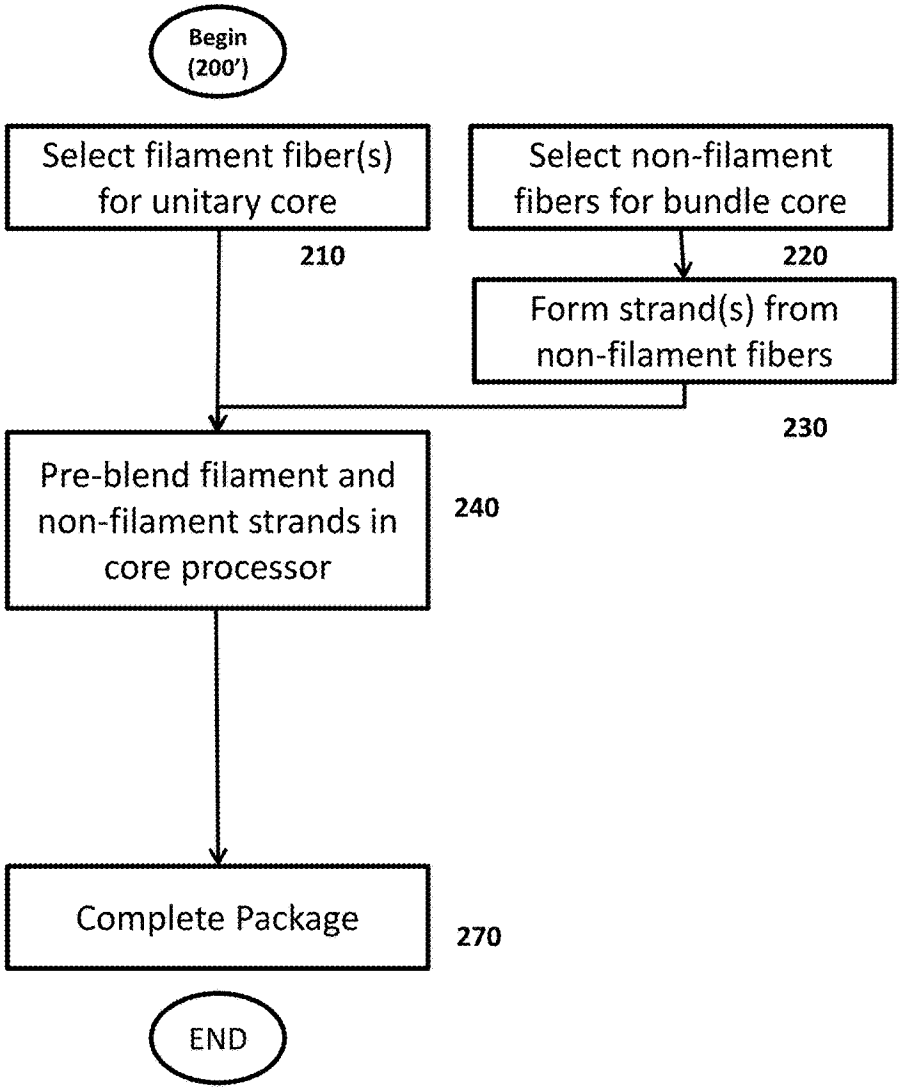
FIG. 4 shows an example of another process for manufacturing a fire retardant or fire resistant yarn, wherein entwined strands of a bundle core may be used as is without the application of a sheath to construct flame barrier or other fire retardant substrates.

FIG. 4 shows an alternate process 200' according to the disclosure, wherein the entwined strands of the bundle core may be used as is without the application of a sheath to construct flame barrier or other fire retardant substrates. In this embodiment, the selection of heat-resistant, filament and non-filament strands precedes their introduction to the core processor, and upon consolidation, the entwined bundle can be fed into a weaving or knitting process, or as previously disclosed, into a sheathing process.

A further embodiment of the disclosure may include the introduction of colored fiber into the core and or the sheath to create aesthetically pleasing colored yarns and or the creation of flame barrier fabrics with colors or patterns woven or knitted in.

Figure 5:
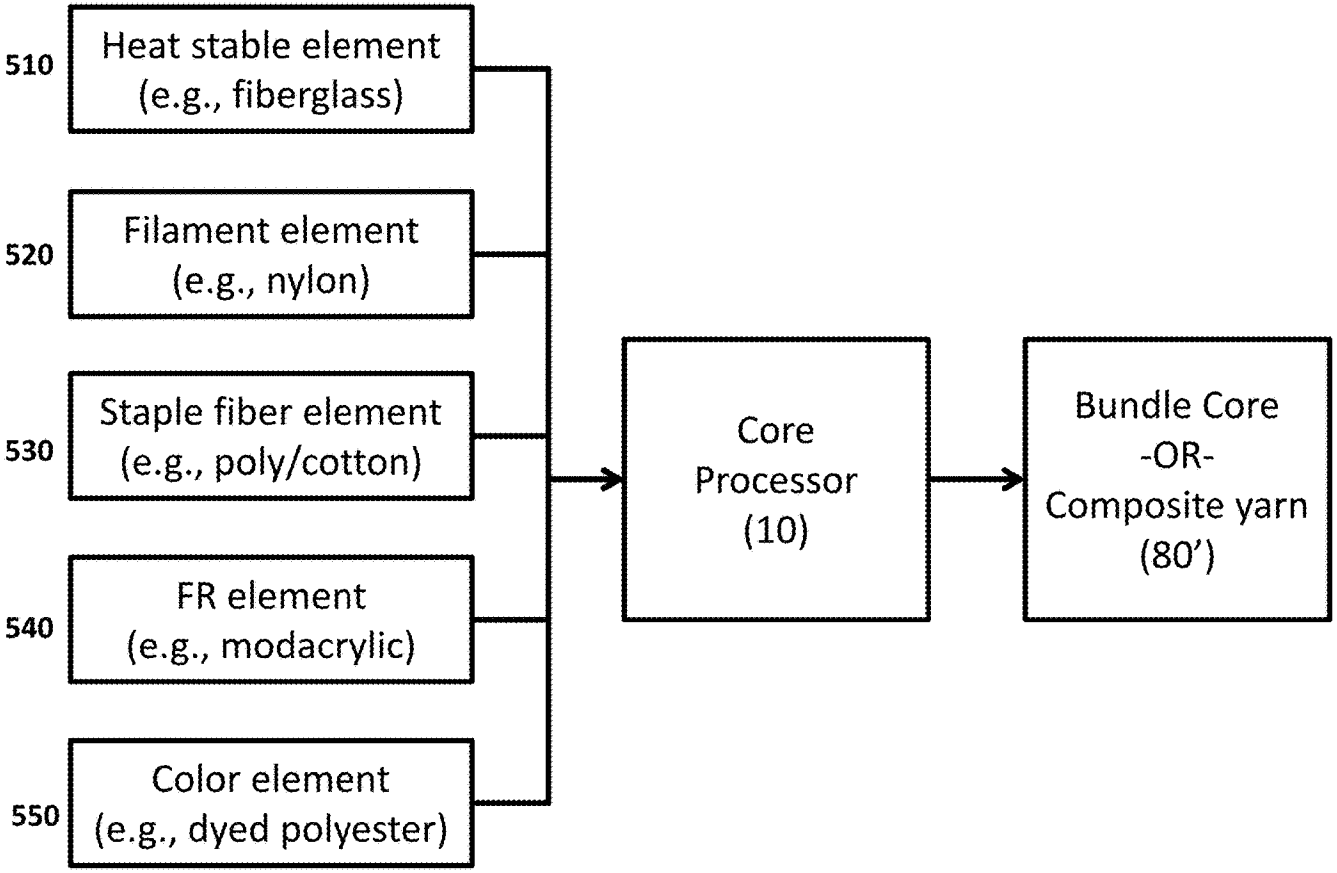
FIG. 5 shows an example of a process for introducing one or more colored strands into a core processor to add color to the bundle core and or the resulting composite yarn.

As shown in FIG. 5, one or more colored strands—whether formed of solution dyed, genetically enhanced (e.g., Sally Fox cotton) fibers, or from dyed yarns, may be introduced into the core processor 10 to add color to the bundle core and or the resulting composite yarn. This color effect may be introduced for aesthetic purposes—e.g., for enhanced consumer appeal—but may also be used for practical purposes including but not limited to identification of specific yarn blends for quality control purposes.

Referring to FIG. 5, one or more of a heat stable element 510 (such as, e.g., fiberglass), a filament element 520 (such as, e.g., nylon), a stable fiber element 530 (such as, e.g., poly/cotton), a FR element 540 (such as, e.g., modacrylic), and/or a color element 560 (such as, e.g., dyed polyester) may be introduced into the core processor 10 to construct a bundle core and/or composite yarn 80'.

In addition, colored yarn or sliver (a loose, untwisted bundle of fiber that is the product of a textile card or drawframe) can be introduced at the sheathing process to add color to a core spun yarn as described in this disclosure. The color may be introduced via, for example, an aqueous textile dyeing process, through the use of dyed or inherently colored fiber, through the recycling of post-industrial or post-consumer polyethylene bottles or through the reclamation of post-consumer clothing and household textiles.

Colored yarns made from this reclamation process may also be introduced at either the core processing or sheathing processes.

The terms "including," "comprising," and variations thereof, as used in this disclosure, mean "including, but not limited to," unless expressly specified otherwise.

The terms "a," "an," and "the," as used in this disclosure, means "one or more," unless expressly specified otherwise.

Although process steps, method steps, algorithms, or the like, may be described in a sequential order, such processes, methods and algorithms may be configured to work in alternate orders. In other words, any sequence or order of steps that may be described does not necessarily indicate a requirement that the steps be performed in that order. The steps of the processes, methods or algorithms described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices which are not explicitly described as having such functionality or features.

While the disclosure has been described in terms of exemplary embodiments, those skilled in the art will recognize that the disclosure can be practiced with modifications in the spirit and scope of the appended claims. These examples are merely illustrative and are not meant to be an exhaustive list of all possible designs, embodiments, applications or modifications of the disclosure.

What is claimed:

1. A method for manufacturing a fire resistant core-spun yarn, the method comprising:

selecting a filament fiber for a core of the core-spun yarn;

selecting one or more companion fibers to form a bundle core;

blending the one or more companion fibers to form the bundle core, which includes the core; and encasing the bundle core in a sheath comprising one or more staple fibers, wherein blending the one or more companion fibers to form the bundle core comprises blending fibers with an affinity for sublistatic dyes or digital inks.

2. The method of claim 1, wherein encasing the bundle core in a sheath comprising one or more staple fibers comprises:

supplying the bundle core to a spinning frame that encases the bundle core in the sheath comprising one or more staple fibers.

3. The method of claim 1, wherein the one or more companion fibers comprise at least one of a filament fiber and a staple fiber.

4. The method of claim 1, wherein blending the one or more companion fibers to form the bundle core comprises blending the filament fiber and a plurality of staple fibers.

5. The method of claim 1, wherein blending the one or more companion fibers to form the bundle core further comprises:

calibrating one or more fire retardant properties through a core processor.

6. The method of claim 1, wherein blending the one or more companion fibers to form the bundle core comprises:

doubling the filament fiber and strands of the one or more companion fibers; and twisting the doubled filament fiber and strands of the one or more companion fibers in a predetermined direction to form the bundle core.

7. The method of claim 6, wherein the predetermined direction comprises:

a clockwise rotation about a longitudinal axis of the bundle core; or a counterclockwise rotation about the longitudinal axis of the bundle core.

8. The method of claim 1, wherein encasing the bundle core in a sheath comprising one or more staple fibers comprises:

intimately blending a plurality of staple fibers; or drawframe blending the plurality of staple fibers; or plying and twisting the bundle core in the sheath comprising the one or more staple fibers; or siro spinning the bundle core in the sheath comprising the one or more staple fibers; or spaced, double-creeled roving feeding a draft zone of a textile spinning frame to form the bundle core within the sheath comprising the one or more staple fibers; or ring spinning the bundle core in the sheath comprising the one or more staple fibers; or air jet spinning the bundle core in the sheath comprising the one or more staple fibers; or friction spinning the bundle core in the sheath comprising the one or more staple fibers.

9. A method for manufacturing a fire resistant core-spun yarn, the method comprising:

blending a filament fiber with a plurality of non-filament fibers to form a unitary core; and sheathing a single layer around the unitary core to form the core-spun yarn, wherein the unitary core is formed to provide high mechanical latching to the non-filament fibers.

10. The method of claim 9, wherein sheathing the single layer around the unitary core comprises:

supplying the unitary core to a spinning frame that encases the unitary core in a sheath comprising the single layer.

11. The method of claim 9, wherein the single layer around the unitary core comprises at least one of a filament fiber and a staple fiber.

12. The method of claim 9, wherein blending the filament fiber with the plurality of non-filament fibers to form the unitary core comprises:

doubling the filament fiber and strands of one or more of the plurality of non-filament fibers; and twisting the doubled filament fiber and strands of the one or more of the plurality of nonfilament fibers in a predetermined direction to form the unitary core.

13. The method of claim 12, wherein the predetermined direction comprises:

a clockwise rotation about a longitudinal axis of the unitary core; or a counterclockwise rotation about the longitudinal axis of the unitary core.

14. The method of claim 9, wherein sheathing the single layer around the unitary core comprises:

intimately blending a plurality of staple fibers; or drawframe blending the plurality of staple fibers; or plying and twisting the unitary core in the sheath comprising the single layer; or siro spinning the unitary core in the sheath comprising the single layer; or spaced, double-creeled roving feeding a draft zone of a textile spinning frame to form the unitary core within the sheath comprising the single layer; or ring spinning the unitary core in the sheath comprising the single layer; or air jet spinning the unitary core in the sheath comprising the single layer; or friction spinning the unitary core in the sheath comprising the single layer.

15. The method of claim 9, wherein the plurality of non-filament fibers comprise a plurality of distinct staple fibers.

16. The method of claim 9, wherein the plurality of non-filament fibers comprise at least three distinct fiber types.

17. The method of claim 9, wherein the plurality of non-filament fibers comprise at least one staple fiber.

18. The method of claim 9, wherein the unitary comprises a blend of at least one of:

an aramid;

a ceramic;

a basalt;

a glass fiber;

a fire retardant rayon;

a polyacrylonitrile (PAN);

an oxidized polyacrylonitrile (OPAN);

a PBI; and a polyetherimide.

19. A fire retardant or flame resistant core-spun yarn, comprising:

a core that includes a blend of a filament fiber and one or more non-filament fibers; and a sheath that substantially encapsulates the core, the sheath comprising one or more staple fibers, wherein the sheath is formed of strands of the one or more staple fibers, and wherein the blend of the filament fiber and the one or more non-filament fibers comprises a blend of fibers with an affinity for sublistatic dyes or digital inks.

20. The fire retardant or flame resistant core-spun yarn of claim 19, wherein the core is formed to provide high mechanical latching to the one or more staple fibers.

* * * * *